US005078396A

United States Patent [19]

Cavallaro et al.

[11] Patent Number: 5,078,396

[45] Date of Patent: Jan. 7, 1992

[54] REINFORCED DUAL-BLADE HOCKEY STICK

[75] Inventors: Paul V. Cavallaro, 5 Paul St., Canton, Mass. 02021; Christopher Cavallaro, Canton, Mass.

[73] Assignee: Paul V. Cavallaro, Attleboro, Mass.

[21] Appl. No.: 394,873

[22] Filed: Aug. 17, 1989

[51] Int. Cl.[5] ..... A63B 59/00

[52] U.S. Cl. ..... 273/67 A

[58] Field of Search ..... 29/525.2; 52/630; 156/91, 92, 185; 273/67, 73 J, 73 F

[56] References Cited

U.S. PATENT DOCUMENTS

| | | | |
|---|---|---|---|
| 2,394,477 | 2/1946 | Pope et al. | 156/92 |
| 2,654,608 | 10/1953 | Liebers | 156/92 |
| 3,350,249 | 10/1967 | Gregoire | 156/92 |
| 4,369,970 | 1/1983 | Salminen | 273/67 A |
| 4,504,344 | 3/1985 | Helle et al. | 156/185 |
| 4,570,932 | 2/1986 | Cote | 273/67 A |
| 4,651,990 | 3/1987 | Profit | 273/67 A |
| 4,793,613 | 12/1988 | Hughes | 273/67 A |

*Primary Examiner*—Edward M. Coven
*Assistant Examiner*—Mark S. Graham
*Attorney, Agent, or Firm*—David Silverstein

[57] ABSTRACT

This invention relates to an improved hockey stick for use in playing ice and street hockey comprising a dual-blade stick with blade reinforcing means spaced inwardly from the point of bifurcation of the two blade toes.

31 Claims, 3 Drawing Sheets

REINFORCED DUAL-BLADE HOCKEY STICK

BACKGROUND OF THE INVENTION AND DISCUSSION OF PRIOR ART

This invention relates to an improved hockey stock for use in playing ice and street hockey.

The standard design for a hockey stick comprises an elongated handle or shaft portion and a single, generally rectangular blade portion disposed at approximately a 90-degree or slightly greater angle with respect to the handle. These sticks are commonly made of wood, plastic, or composite materials such as fiberglass. It has been common to use blades that are curved in a forwardly concave direction to improve puck control and forward shooting ability. The disadvantage of a curved blade, however, is that the curvature adversely affects backhand shots because the puck may slide or be deflected off the convex rear surface instead of being squarely hit in the desired direction of travel.

Recently, this problem has been addressed by the development of dual-blade hockey sticks comprising a split or bifurcated blade in which the front (forward-facing) blade toe is forwardly concave and the rear (rear-facing) blade toe is substantially flat. Such dual-blade hockey sticks are described in U.S. Pat. Nos. 4,570,932 to George R. Cote and 4,793,613 and 4,799,682 to Owen P. Hughes. The disclosures of these patents are incorporated herein by reference.

The Cote patent utilizes a wedge of a relatively soft material positioned at the tip of the blade in order to create a winged tip resulting in a forward surface curvature while retaining a more or less flat rear surface. The Hughes patents describe a dual-blade hockey stick in which there is no separating spacer or wedge between the "toes" of the blade (as in the Cote stick) thereby permitting the forward and rear toes to flex independently.

Most ice hockey blades are laminated with wood and/or fiberglass. The individual laminae or plies are held together with some type of adhesive bond. These adhesive-type bonds work fine when supporting in-plane shear loads but not the inherent tensile load associated with the dual-blade sticks, especially where the forward and rear toes flex independently as in the Hughes hockey stick. On the other hand, street hockey blades are typically molded in plastic as one material.

For both laminated and molded constructions, however, an open V-shaped blade is extremely susceptible to fracture. Out-of-plane (plane of blade) or through-the-thickness tensile stresses cause fracture by the formation of cracks or delaminations between the separate blades originating near the root of the V-joint and propagating towards the heel. A fulcrum effect was found to exist in the vicinity of the V-joint. In other words, displacement of points located before the root would be opposite in sense from those located beyond the root. Blade forces resulting from slapshots, backhand shots, and so forth, induce out-of-plane tensile stresses localized in the vicinity of the root. These detrimental tensile stresses are an inherent characteristic of the bifurcated blade geometry and exist in both laminated (ice) and molded (street) hockey blades.

Indeed, recent experience with the existing dual-blade hockey sticks has confirmed that in use these sticks have a relatively short and unsatisfactory playing life. Stresses and strains generated by repeated striking of the hockey puck, other players' sticks, the ice (or ground), and so forth rapidly lead to stress fractures at and behind the point of bifurcation or crotch of the dual blade leading to eventual separation and premature failure.

OBJECTS OF THE INVENTION

A principal object of this invention is to provide an improved dual-blade hockey stick for use in playing ice and street hockey.

A further object of this invention is to provide a dual-blade hockey stick having blade reinforcing means to extend the useful playing life of these sticks.

Still a further object of this invention is to provide a dual-blade hockey stick with blade reinforcing means disposed at a particular location so as to maximize the effectiveness of the reinforcing means while minimizing the cost, weight, and obtrusiveness of the reinforcing means.

Specifically, it is an object of this invention to provide a dual-blade hockey stick with blade reinforcing means centered on a point spaced inwardly from the point of bifurcation or crotch of the dual blade.

These and other objects and advantages of this invention will become apparent in the following description.

DETAILED DESCRIPTION AND PREFERRED EMBODIMENTS

Figure 1:
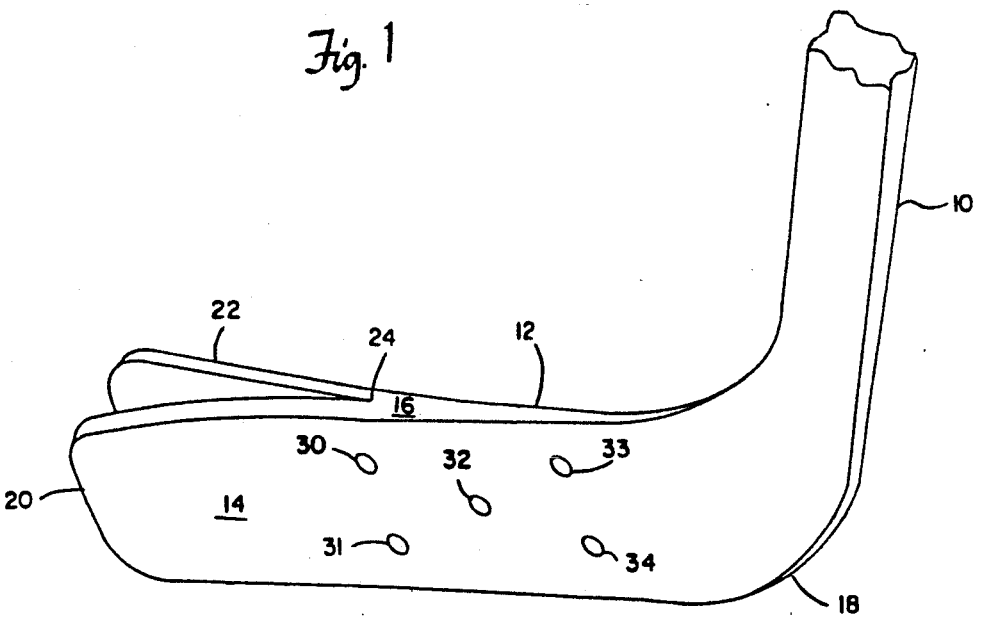
FIG. 1 is an isometric view of the blade end of a dual-blade hockey stick in accordance with one embodiment of this invention.

Referring to FIG. 1, the hockey stick of this invention broadly comprises a handle or shaft portion 10 integral with a blade portion 12. It will be appreciated that only the lower part of shaft 10 where it joins blade 12 is shown. The length of shaft 10 may vary to suit the needs of shorter or taller hockey players. Alternatively, instead of making shaft 10 and blade 12 integral, it is contemplated that the dual blades of this invention can be made and sold independently of the shafts and provided with suitable means for securely attaching the blades to the shafts. Replaceable-blade hockey sticks and the associated attachment means are well-known in the art.

Shaft 10 and blade 12 may be made of wood, plastic, or various composite materials such as fiberglass. Included in the range of possible variations is a sandwich blade construction comprised of composite outer skins and a closed-cell foam core with a high compressive strength. Composite materials might include graphite, fiberglass, kevlar and any possible hybrids. These materials may be procured in either dry or prepared forms. Since the blade should be lightweight and sufficiently strong, a material or hybrid with a high strength-to-weight ratio should be used. A target weight for the complete shaft and blade assembly ranging between 22 to 28 ounces is optimum.

Strength and weight of the blade should be optimized by calculating the ideal fiber orientations and ply stacking percentage of longitudinal fibers (0 degree) for bending strength and a minimum of transverse (90 degree) and angle (45 degree) plies for transverse and shear strength respectively. The majority of the longitudinal plies should be located symmetrically as far away from the blade's neutral axis as possible. Weight of the blade should also be minimized by controlling the thicknesses of the curved and backhanded blades. The backhand blade should be made thinner because blade forces imposed by backhand shots are considerably less than those resulting from forehand slapshots.

Blade 12 has generally rectangular front and rear playing surfaces with rounded corners when viewed from the front playing surface 14 or the rear playing surface (not seen in FIG. 1). It should be appreciated that the hockey stick shown in FIG. 1 is a "right-handed" stick designed to be used by right-handed hockey players, but the present invention can also be used for "left-handed" sticks. Blade 12 includes a rounded heel end 18 where it joins handle 10, an upper side edge 16, and a lower side edge (not seen in FIG. 1) which is the part of the blade most commonly in contact with the ice (or ground in the case of street hockey) during play. Blade 12 also includes a bifurcated toe portion at its forward end comprising a front toe 20 and a rear toe 22 joining the body of blade 12 at the crotch or juncture 24.

Figure 3:
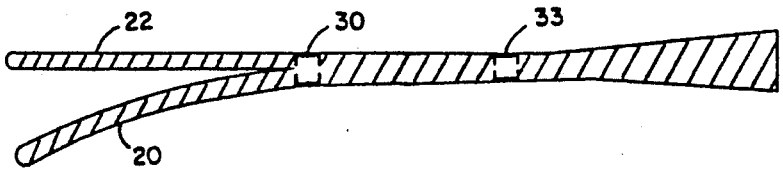
FIG. 3 is a sectional top view of the blade along the axis 3—3 in FIG. 2.

In the preferred embodiment of this invention, front toe 20 has a slight forwardly concave curvature (i.e., convex with respect to rear toe 22) whereas rear toe 22 has little or no curvature, as better seen in FIG. 3. It is within the scope of this invention, however, to use a front toe 20 with little or no curvature. It is also within the scope of this invention to use a rear toe 22 that has a slight rearwardly concave curvature. In any case, toe segments 20 and 22 are integral with the body of blade 12 providing a smooth, continuous front playing surface 14 and rear playing surface (not seen in FIG. 1).

Blade 12 includes reinforcement means spaced inwardly toward heel 18 from crotch or juncture 24. The locus or focal point of said reinforcement means is preferably centered between the upper and lower edges of front playing surface 14 and spaced inwardly from the juncture 24 a distance of approximately one-half to four times, preferably about one to three times, the width or thickness of side edge 16 at juncture 24. The width of side edge 16 at juncture 24 is typically about ¼"-¾". Thus, the locus of the blade reinforcement means should typically be spaced inwardly from juncture 24 a distance of about ⅛" to 3", preferably about ¼"-2", depending on the thickness of the side edge.

In one reinforcement embodiment shown in FIG. 1, five mechanical spot fasteners 30, 31, 32, 33 and 34 are disposed in a generally X-shaped pattern in apertures passing from the front playing surface 14 to the rear playing surface. The fasteners of this invention can be selected from among any of the conventional fasteners. Conventional spot fasteners include rivets, threaded inserts, screws, nails and others. The choice of fastener is only restricted by the need for smooth front and rear playing surfaces on blade 12. For some fasteners, this might require countersinking the fastener on one or both sides and filling the holes for example with fiberglass or epoxy. It is also preferred that the fasteners be preloaded to create and maintain a compressive or clamping force through the thickness of the blade.

In FIG. 1 five aluminum pop rivets are utilized as the reinforcement means. The locus or focal point of the generally X-shaped reinforcement pattern in FIG. 1 is center rivet 32 which is approximately centered between the upper side edge 16 and the lower side edge of front playing surface 14 and is spaced inwardly from juncture 24 a distance of approximately two times the width of side edge 16 at juncture 24. In the preferred embodiment, the distance between the corner rivets 30 and 33 and between corner rivets 31 and 34 is approximately two to four times the width of side edge 16 at juncture 24. In an alternative configuration not shown, three spot fasteners could be used—i.e., center fastener 32 together with one fastener above and one below center fastener 32. In some applications, two or even one spot fastener properly positioned a distance of one to three blade widths inwardly from juncture 24 would suffice for reinforcement.

Figure 2:
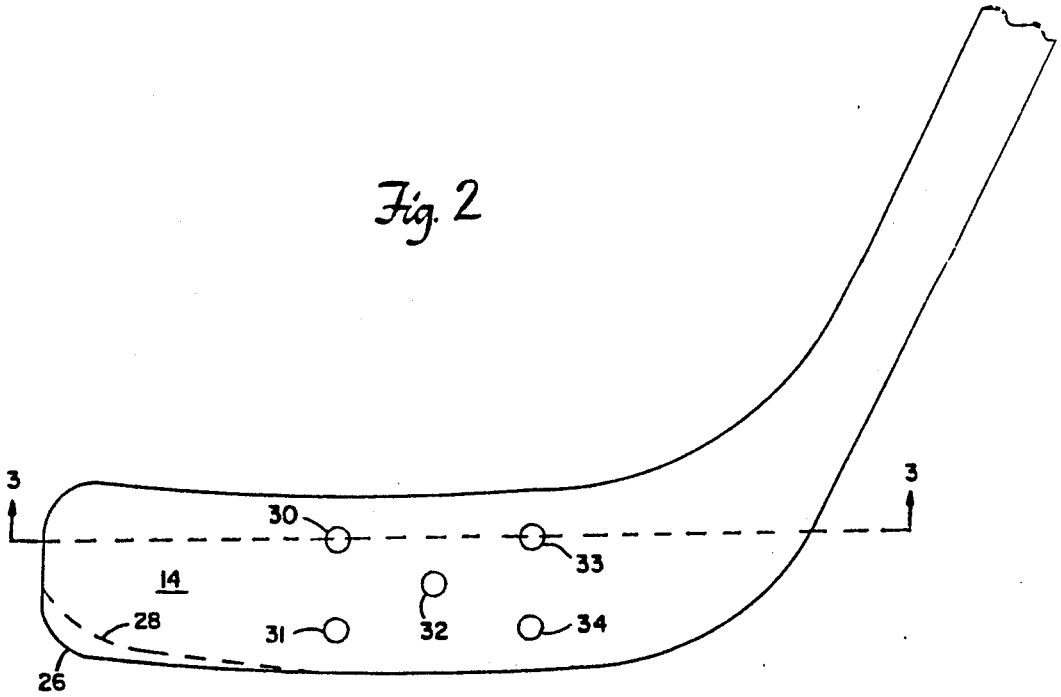
FIG. 2 is a schematic side view of the forward portion of the blade shown in FIG. 1.

FIG. 2 is a side view of front playing surface 14 of blade 12. FIG. 2 illustrates another preferred embodiment of this invention in which the forward tip and forward ice edge of rear toe 22 (FIG. 1) is cut back to create cut-back edge 28 (shown in dotted outline in FIG. 2). By contrast, front toe 20 has a full-cut edge 26. The advantage of using a cut-back edge 28 on rear toe 22 is to help prevent rear toe 22 from catching on the ice (or ground) and thereby interfering with a forward slapshot.

FIG. 3 is a section top view of blade 12 along the axis 3—3 in FIG. 2. FIG. 3 better illustrates the slight forward concave curvature of front toe 20 whereas rear toe 22 is seen to have little or no curvature. Also seen in FIG. 3 are pop rivet fasteners 30 and 33 in cross section.

Figure 4:
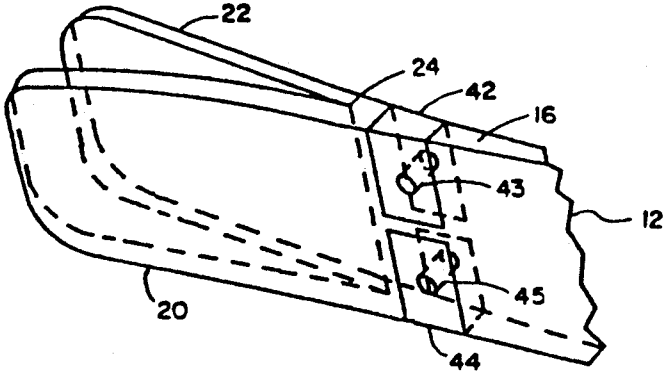
FIG. 4 is a schematic isometric view of the toe end of a dual-blade hockey stick in accordance with a second embodiment of this invention.

FIG. 4 is a schematic isometric view of the toe end of the dual-blade hockey stick of this invention showing an alternative reinforcing means. In this embodiment, edge clips 42 and 44 are positioned at a distance of approximately two blade widths inwardly from juncture 24. As shown in FIG. 4, the inside faces of clips 42 and 44 may include rivet-like fastener means designed to align and engage respectively with apertures 43 and 45 in blade 12. In accordance with this invention, the locus of the center lines of apertures 43 and 45 are spaced inwardly from juncture 24 a distance of approximately one-half to four times, preferably about one to three times, the width or thickness of side edge 16 at juncture 24. Clips 42 and 44 may be made of metal, plastic or comparable materials combining strength, light weight, and at least some flexibility. In the preferred embodiment, the side or width of clips 42 and 44 is approximately one-three times the width of side edge 16 at juncture 24.

Figure 5:
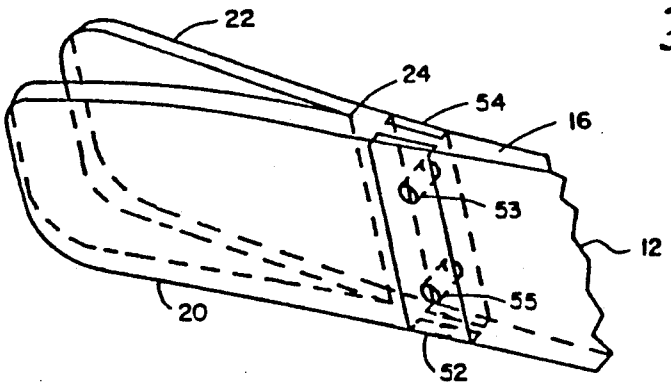
FIG. 5 is a schematic isometric view of the toe end of a dual-blade hockey stick in accordance with a third embodiment of this invention.

FIG. 5 is a schematic isometric view of the toe end of the dual-blade hockey stick of this invention showing still another type of reinforcing means. In this embodiment, side collars 52 and 54 are positioned at a distance of approximately two blade widths inwardly from juncture 24. As shown in FIG. 5, the inside faces of collars 52 and 54 may include rivet-like fastener means designed to align and engage with apertures 53 and 55 in blade 12. In accordance with this invention, the locus of the center lines of apertures 53 and 55 are spaced inwardly from juncture 24 a distance of approximately one-half to four times, preferably about one to three times, the width or thickness of side edge 16 at juncture 24. Collars 52 and 54 may be made of metal, plastic or comparable materials combining strength, light weight and at least some flexibility. In the preferred embodiment, the side or width of collars 52 and 54 is approximately one–three times the width of side edge 16 at juncture 24.

Figure 6:
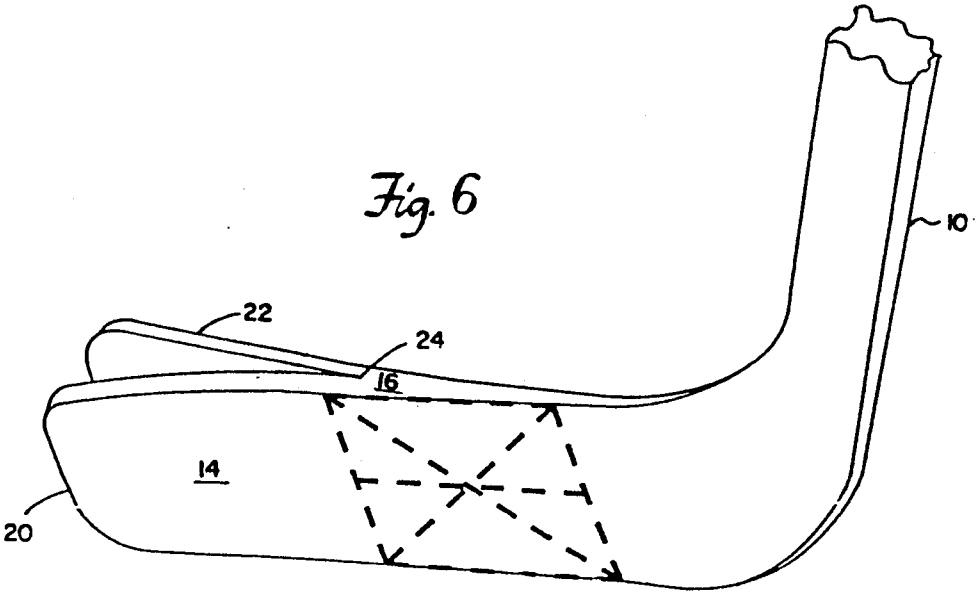
FIG. 6 is an isometric view of the blade end of a dual-blade hockey stick in accordance with a fourth embodiment of this invention.

FIG. 6 is a schematic isometric view of the blade end of the dual-blade hockey stick of this invention showing still another type of reinforcing means. In this embodiment, the blade reinforcement is provided by stitching (shown as dotted lines in FIG. 6) along front playing surface 14 and the rear playing surface (not seen in FIG. 6) of blade 12 using a high tensile modulus/high strength fiber in a particular pattern, the locus or focal point of which is approximately centered between the upper and side edge 16 and the lower side edge of front playing surface 14 and is spaced inwardly from juncture 24 a distance of approximately two blade widths. A particularly suitable material for use as a stitching reinforcement is carbon fiber. Although this embodiment is especially suitable for use with a blade comprising a man-made composite material such as fiberglass, stitching reinforcement can also be used with conventional wood and plastic blades.

As illustrated in FIG. 6, the preferred stitching is in a more or less X-shaped pattern, either with perimeter border stitching (as shown) or without. In the preferred embodiment, the distance between the upper two corners of the X-shaped pattern, as well as the distance between the lower two corners, is approximately two to four times the width of side edge 16 at juncture 24. Other stitching patterns are contemplated and are within the scope of this invention. In accordance with this invention, the locus or focal point of the stitching pattern is spaced inwardly from juncture 24 a distance of approximately one-half to four times, preferably about one to three times, the width or thickness of side edge 16 at juncture 24.

A variety of other conventional reinforcement means are contemplated as also being within the scope of this invention. These devices could be either external add-ons or internal blade components, for example, a collar or band device consisting of circumferential (hoop), braided or fiberglass wrap. ("Braiding" is a relatively new composite processing method that is recognized and described in current technical literature.) This collar would resist the out-of-plane tensile stresses and prevent separation of the blade's plies. However, it would also increase blade thickness as well as weight. Varieties of fasteners, clips, collars and bands other than those specifically described above may also be used for reinforcement within the scope of this invention.

Figure 7:
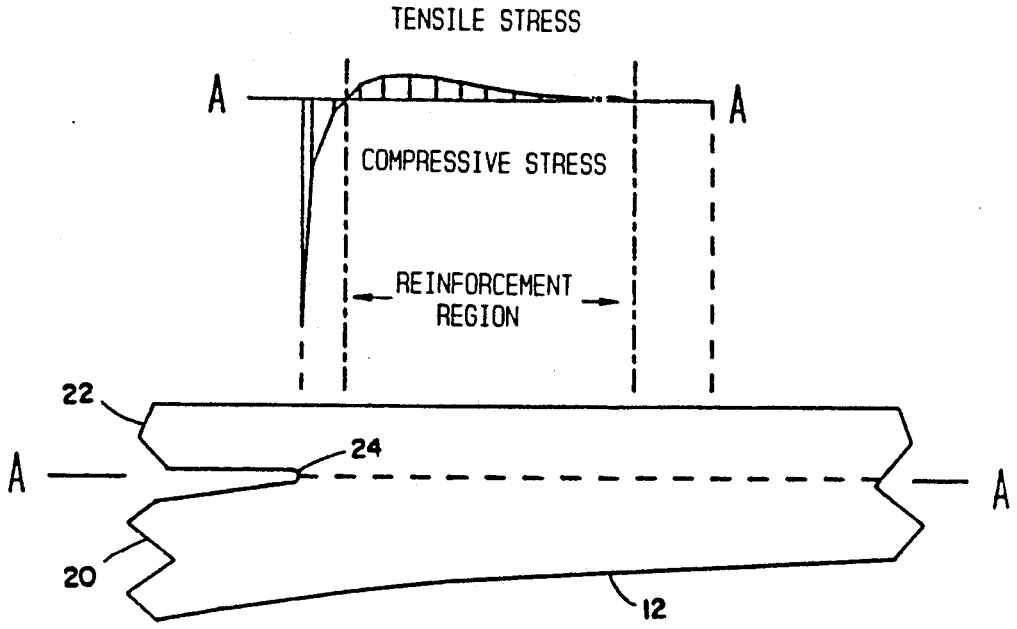
FIG. 7 is a schematic stress diagram that plots the through-the-thickness stress distribution laterally along the blade portion of the dual-blade hockey stick upon impact between the blade and a hockey puck.
Figure 8:
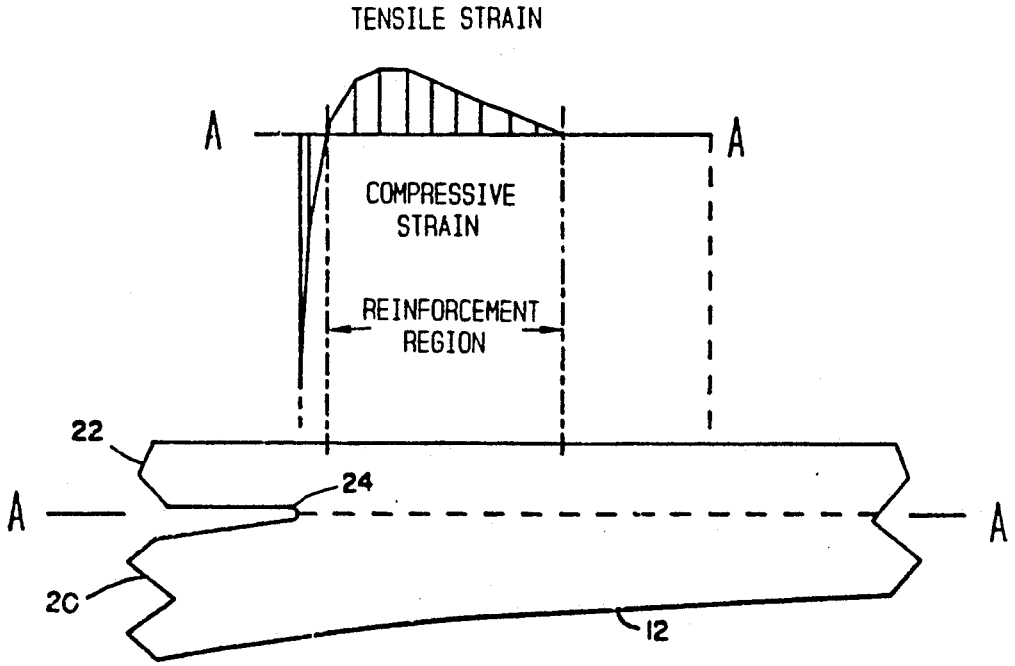
FIG. 8 is a schematic strain diagram that plots the through-the-thickness strain distribution laterally along the blade portion of the dual-blade hockey stick upon impact between the blade and a hockey puck.

FIG. 7 is a schematic stress diagram that plots the regions of through-the-thickness tensile and compressive stresses laterally along blade 12 from juncture 24 inwardly toward heel 18 (see FIG. 1) upon impact between the blade and a hockey puck. FIG. 8 is a schematic strain diagram comparable to FIG. 7 except that it plots tensile and compressive strains laterally along blade 12 upon impact between the blade and a hockey puck. FIGS. 7 and 8 represent the average composite results of actual test measurements obtained under actual and simulated playing conditions.

Intuitively, one would expect the internal forces on blade 12 during actual use to be concentrated along the length of juncture 24. This analysis would lead one to reinforce the dual-blade hockey stick by reinforcing the V-shaped interior portion of juncture 24, for example with a soft, shock-absorbing wedge as in the cote U.S. Pat. No. 4,570,932. From a practical standpoint, the V-shaped interior of juncture 24 is also the easiest to reinforce because reinforcement means can be situated at this location without concern about interfering with the front and rear playing surfaces of blade 12.

The surprising, counter-intuitive, and wholly unexpected test results, however, as reflected by FIGS. 7 and 8, demonstrated that reinforcement means situated right at juncture 24 or outward toward the toes of the blade would be of little or no utility because the locus of the tensile stresses and strains in blade 12 upon impact with a hockey puck was at a distance inward from juncture 24 in the direction of the heel 18 of blade 12. Specifically, the test results demonstrated that tensile stresses and strains in blade 12 upon impact with a hockey puck were concentrated over a relatively small region of the blade spaced inwardly from juncture 24 a distance that correlated to the width or thickness of side edge 16 at juncture 24. Depending upon such variables as the composition and structure of the blade, the force and angle of impact with the hockey puck, and whether the front or rear toe was struck (i.e., forehand or backhand shot), the test results showed that the locus of the stress and strain forces in blade 12 was spaced inwardly from juncture 24 a distance ranging from about one-half to four times the width of side edge 16 at juncture 24 and covering a region approximately one to four times the width of side edge 16 at juncture 24.

Based on the aforementioned data, the reinforcing means of this invention have been designed to obtain the maximum amount of reinforcement while minimizing the size and weight of the reinforcing means and minimizing interference with the playing surfaces of the hockey blade. More particularly, the reinforcing means of this invention have a locus or focal point in precisely that region of the blade where stresses and strains are concentrated upon impact between the blade and a hockey puck. Also, the size or width of the reinforcing area is specifically related to the size of the region of the blade that experiences tensile stresses and strains upon impact between the blade and a puck.

The details of fabricating dual-blade hockey sticks in accordance with this invention will be better understood by reference to the following examples.

EXAMPLE #1

A wooden/fiberglass replacement-type dual blade was made using laminating plies of wood (e.g., birch veneer) and fiberglass and was fitted to an aluminum hockey shaft. This particular blade was fabricated by joining a curved replacement-type blade with a straight blade. The outside surface of the curved blade was machined at the interface formed by the blade's heel and the shaft to provide a right-angled cut-out. This cut-out was oriented parallel to the shaft and was a half-blade thickness in depth. The backhand or straight blade was machined to mate flush with the cut-out of the curved blade. Any fiberglass cloth originally existing on these blades was removed. Both blades were then joined together using an epoxy adhesive and then cured under pressure. Once the adhesive was cured, five aluminum pop rivets were installed in a generally X-shaped pattern as illustrated in FIG. 1. The locus or focal point of the X-shaped rivet pattern, namely the center rivet, was spaced inwardly from the bifurcation point a distance of 1", which was twice the thickness of the side edge at the bifurcation point. The upper corner rivets, as well as the lower corner rivets, were spaced 1½" apart, which was three times the thickness of the side edge at the bifurcation point. Aluminum rivets were used to maintain compliance with the NCAA rule book which allows the use of aluminum. Holes for each rivet were countersunk so that the rivet heads remained flush with both blade surfaces. The depth of the countersinks was minimal. Next, the dual blade assembly was finish-sanded. A layer of fiberglass cloth was adhered to the blades' inner surface. Beginning at the toe end of one inner blade surface, fiberglass cloth was positioned toward the crotch, continuing along the crotch and ending at the toe end of the other inner blade surface. The outer blade surfaces were also wrapped with fiberglass woven cloth. The dual blade was then fitted to an aluminum hockey shaft.

EXAMPLE #2

In this wooden/fiberglass dual-blade construction, instead of joining the two separate blades with a sharp cut-out, stress concentrations in the heel vicinity were reduced by using a tapered joint configuration. Also, before wrapping the fiberglass, chamfering of both sides of the dual blade at its bottom edge allowed the blade to better grip the puck.

EXAMPLES #3-5

Additional prototypes were also manufactured. These included one right-handed and two left-handed dual blades. The same fabrication processes used to develop the #2 prototype blade were used for prototypes #3 and 4. However, the head diameter of the rivets were increased from ⅛" to 3/16". Prototype #3 used four rivets and #4 used three rivets. The same circumferential fiberglass wrap used for prototype #'was also used for prototype #5. However, only three 3/16" diameter rivets were used in blade #5.

After one hour of play, prototype #3 was inspected for possible damage. A tensile failure of the top pop rivet closest to the root of the crotch was observed and readily attributed to faulty rivet installation. Initially, the countersunk depths were not deep enough to allow the rivet heads to seat below the blades' surfaces. However, the other rivets did not fail and continued to function properly. After inspection, the stick continued to perform satisfactorily in play. Prototype #4 was used in normal play showing no signs of damage. Prototype #5 successfully withstood over 20 slapshots without sustaining any damage whatsoever.

Many other variations and modifications of our basic design will be readily apparent to those skilled in the art. All such variations and modifications are within the spirit and the scope of this invention and, therefore, are intended to be encompassed by the following claims:

Having described our invention, what we claim is:

1. A hockey stick comprising in combination an elongated shaft; a blade disposed at one end of said shaft wherein said blade comprises generally rectangular front and rear playing surfaces, upper and lower side edges, a heel portion adjacent to said shaft and a bifurcated toe portion at the opposite end thereof defining a juncture along said blade; and blade reinforcement means comprising rivets or rivet-like fasteners disposed in apertures passing through said blade from said front playing surface to said rear playing surface, said reinforcement means being positioned relative to said juncture to create through-the-thickness blade reinforcement against internal tensile forces such that said reinforcement has a locus that is spaced inward from said juncture a distance of approximately one-half to four times the thickness of the side edges of said blade at said juncture.

2. The hockey stick of claim 1 wherein said fasteners comprise five rivets disposed in a generally X-shaped pattern on the front and rear playing surfaces of said blade and the center rivet of said X-shaped pattern is spaced inward from said juncture a distance equal to about one-half to four times the thickness of the side edges of said blade at said juncture.

3. The hockey stick of claim 2 wherein said rivets include two upper corner rivets spaced from each other a distance equal to two to four times the thickness of the side edges of said blade at said juncture.

4. The hockey stick of claim 2 wherein said rivets include two lower corner rivets spaced from each other a distance equal to two to four times the thickness of the side edges of said blade at said juncture.

5. A hockey stick comprising in combination an elongated shaft; a blade disposed at one end of said shaft wherein said blade comprises generally rectangular front and rear playing surfaces, upper and lower side edges, a heel portion adjacent to said shaft and a bifurcated toe portion at the opposite end thereof defining a juncture along said blade; and blade reinforcement means comprising U-shaped clip fasteners designed to engage said blade by being seated on one side edge thereof such that the legs of each U-shaped fastener respectively contact the front and rear playing surfaces of the blade, further wherein each of said clip fasteners includes at least one rivet-like projection disposed in apertures passing through said blade from said front playing surface to said rear playing surface, said reinforcement means being positioned relative to said juncture to create through-the-thickness blade reinforcement against internal tensile forces such that said reinforcement has a locus that is spaced inward from said juncture a distance of approximately one-half to four times the thickness of the side edges of said blade at said juncture.

6. The hockey stick of claim 8 wherein said apertures are spaced inward from said juncture a distance equal to one-half to four times the thickness of the side edges of said blade at said juncture.

7. The hockey stick of claim 5 wherein said clip fasteners have a width equal to one to three times the thickness of the side edges of said blade at said juncture.

8. A hockey stick comprising in combination an elongated shaft; a blade disposed at one end of said shaft wherein said blade comprises generally rectangular front and rear playing surfaces, upper and lower side edges, a heel portion adjacent to said haft and a bifurcated toe portion at the opposite end thereof defining a juncture along said blade; and blade reinforcement means comprising two C-shaped collar fasteners designed to engage said blade by being seated respectively on the front and rear playing surfaces thereof, further wherein said fasteners are connected by at least one rivet disposed in apertures passing through said blade from said front playing surface to said rear playing surface, said reinforcement means being positioned relative to said juncture to create through-the-thickness blade reinforcement against internal tensile forces such that said reinforcement has a locus that is spaced inward from said juncture a distance of approximately one-half to four times the thickness of the side edges of said blade at said juncture.

9. The hockey stick of claim 8 wherein said apertures are spaced inward from said juncture a distance equal to one-half to four times the thickness of the side edges of said blade at said juncture.

10. The hockey stick of claim 8 wherein said collar fasteners have a width equal to one to three times the thickness of the side edges of said blade at said juncture.

11. In a dual-blade hockey stick comprising in combination an elongated shaft and a bifurcated blade having front and rear toes defining front and rear playing surfaces disposed at one end of said shaft wherein said front and rear toes meet at a blade bifurcation point, the improvement which comprises blade reinforcement means comprising rivets, screws, or threaded internal connectors, said reinforcement means being positioned relative to the blade bifurcation point to create through-the-thickness blade reinforcement against internal tensile forces such that said reinforcement has a locus that is spaced inward from said blade bifurcation point toward the shaft end of said blade a distance equal to about one-half to four times the thickness of said blade at said bifurcation point.

12. The dual-blade hockey stick of claim 11 wherein said blade comprises a sandwich-like construction consisting of a composite outer skin and a closed-cell foam core.

13. In a dual-blade hockey stick comprising in combination an elongated shaft and a bifurcated blade having front and rear toes defining front and rear playing surfaces disposed at one end of said shaft wherein said front and rear toes meet at a blade bifurcation point, the improvement which comprises blade reinforcement means comprising U-shaped clip fasteners designed to engage said blade by being seated on one side edge thereof such that the legs of each U-shaped fastener respectively contact the front and rear playing surfaces of the blade, further wherein each of said clip fasteners includes at least one rivet-like projection disposed in apertures passing through said blade from said front playing surface to said rear playing surface, said reinforcement means being positioned relative to the blade bifurcation point to create through-the-thickness blade reinforcement against internal tensile forces such that said reinforcement has a locus that is spaced inward from said blade bifurcation point toward the shaft end of said blade a distance equal to about one-half to four times the thickness of said blade at said bifurcation point.

14. In a dual-blade hockey stick comprising in combination an elongated shaft and a bifurcated blade having front and rear toes defining front and rear playing surfaces disposed at one end of said shaft wherein said front and rear toes meet at a blade bifurcation point, the improvement which comprises blade reinforcement means comprising two C-shaped collar fasteners designed to engage said blade by being seated respectively on the front and rear playing surfaces thereof, further wherein said fasteners are connected by at least one rivet disposed in apertures passing through said blade from said front playing surface to said rear playing surface, said reinforcement means being positioned relative to the blade bifurcation point to create through-the-thickness blade reinforcement against internal tensile forces such that said reinforcement has a locus that is spaced inward from said blade bifurcation point toward the shaft end of said blade a distance equal to about one-half to four times the thickness of said blade at said bifurcation point.

15. In a dual blade for use on hockey sticks comprising generally rectangular front and rear playing surfaces, upper and lower side edges, a heel portion and a bifurcated toe portion at the opposite end thereof consisting of a front toe having a leading edge and a surface contact edge, a rear toe having a leading edge and a surface contact edge, said front and rear toes meeting at a crotch, the improvement which comprises blade reinforcement means comprising rivet-like fasteners, U-shaped clip fasteners, or C-shaped collar fasteners, said reinforcement means being positioned relative to the crotch to create through-the-thickness blade reinforcement against internal tensile forces such that said reinforcement has a locus that is spaced inward from said crotch toward said heel portion a distance equal to about one-half to four times the thickness of said side edges of said blade at said crotch.

16. The dual blade of claim 15 wherein the leading edge and the surface contact edge of said rear toe are cut back with respect to the leading edge and the surface contact edge of said front toe.

17. The dual blade of claim 15 wherein said front toe is convex with respect to said rear toe and said rear toe is substantially free of curvature.

18. The dual blade of claim 15 wherein said blade comprises a sandwich-like construction consisting of a composite outer skin and a closed-cell foam core.

19. The dual blade of claim 15 wherein the thickness of said rear toe is less than the thickness of said front toe.

20. The dual blade of claim 15 wherein said blade reinforcement means comprise rivets disposed in apertures passing through said blade from said front playing surface to said rear playing surface.

21. The dual blade of claim 20 wherein said rivets are disposed in a generally X-shaped pattern on the front and rear playing surfaces of said blade with a center rivet of said X-shaped pattern spaced inward from said crotch a distance equal to about one-half to four times the thickness of the side edges of said blade at said crotch.

22. The dual blade of claim 21 wherein said rivets include two upper corner rivets spaced from each other a distance equal to about two to four times the thickness of the side edges of said blade at said crotch.

23. The dual blade of claim 21 wherein said rivets include two lower corner rivets spaced from each other a distance equal to about two to four times the thickness of the side edges of said blade at said crotch.

24. The dual blade of claim 15 wherein said blade reinforcement means comprise clip fasteners designed to engage said blade along at least one of the side edges thereof.

25. The dual blade of claim 24 wherein said clip fasteners include rivet-like fasteners disposed in apertures passing through said blade from said front playing surface to said rear playing surface.

26. The dual blade of claim 25 wherein said apertures are spaced inward from said crotch a distance equal to about one-half to four times the thickness of the side edges of said blade at said crotch.

27. The dual blade of claim 24 wherein said clip fasteners have a width equal to about one to three times the thickness of the side edges of said blade at said crotch.

28. The dual blade of claim 15 wherein said blade reinforcement means comprise collar fasteners designed to engage said blade along the front and rear playing surfaces thereof.

29. The dual blade of claim 28 wherein said collar fasteners include rivet-like fasteners disposed in apertures passing through said blade from said front playing surface to said rear playing surface.

30. The dual blade of claim 29 wherein said apertures are spaced inward from said crotch a distance equal to about one-half to four times the thickness of the side edges of said blade at said crotch.

31. The dual blade of claim 28 wherein said collar fasteners have a width equal to about one to three times the thickness of the side edges of said blade at said crotch.

* * * * *

UNITED STATES PATENT AND TRADEMARK OFFICE

CERTIFICATE OF CORRECTION

PATENT NO. : 5,078,396

DATED : January 7, 1992

INVENTOR(S) : Paul V. Cavallaro, et al

It is certified that error appears in the above-identified patent and that said Letters Patent is hereby corrected as shown below:

Col. 6, line 10 - "cote" should be -- Cote --.

Col. 8, line 51 - "claim 8" should be -- claim 5 --.

Col. 8, line 62 - "haft" should be -- shaft --.

Signed and Sealed this

Eighteenth Day of May, 1993

*Attest:*

*Attesting Officer*

Michael K. Kirk

MICHAEL K. KIRK

*Acting Commissioner of Patents and Trademarks*